United States Patent [19]

Girault et al.

[11] Patent Number: 5,007,656

[45] Date of Patent: Apr. 16, 1991

[54] CROSS-COUNTRY SKI BINDING WITH AUTOMATIC CLOSURE

[75] Inventors: Eric Girault, Seynod; Paul Arnulf, Alby sur Cheran, both of France

[73] Assignee: Salomon S.A., Annecy Cedex, France

[21] Appl. No.: 388,387

[22] Filed: Aug. 2, 1989

[30] Foreign Application Priority Data

Aug. 5, 1988 [FR] France ..... 88 10773

[51] Int. Cl.[5] ..... A63C 9/20

[52] U.S. Cl. ..... 280/615

[58] Field of Search ..... 280/615, 628, 631, 632

[56] References Cited

U.S. PATENT DOCUMENTS

| | | | |
|---|---|---|---|
| 4,722,613 | 2/1988 | Jungkind | 280/615 |
| 4,856,807 | 8/1989 | Dunand et al. | 280/615 |
| 4,893,830 | 1/1990 | Dunand et al. | 280/615 |

FOREIGN PATENT DOCUMENTS

| | | | |
|---|---|---|---|
| 0131234 | 1/1985 | European Pat. Off. | 280/615 |
| 0193686 | 9/1986 | European Pat. Off. | 280/615 |
| 3528923 | 3/1986 | Fed. Rep. of Germany | 280/615 |
| 2609378 | 7/1988 | France | 280/615 |

OTHER PUBLICATIONS

Rottefella Publication, "The Ultimate Performance System", Rottefella, Norway.

*Primary Examiner*—David M. Mitchell

*Attorney, Agent, or Firm*—Sandler, Greenblum & Bernstein

[57] ABSTRACT

Cross-country ski binding for a shoe or boot having a transverse journal axle includes a latch which is longitudinally and rotationally movable between latching and insertion positions. A biasing element biases the latch in a longitudinal direction towards the latching position and rotationally towards the insertion position. The arrangement of the elastic element allows the biasing force to overcome in the vertical direction to be less than that in the longitudinal direction.

47 Claims, 2 Drawing Sheets

CROSS-COUNTRY SKI BINDING WITH AUTOMATIC CLOSURE

BACKGROUND OF THE INVENTION

1. Field of the Invention

The present invention relates to an automatic cross-country ski binding of the hinge type, i.e. a binding which is automatically closed by the positioning of the shoe or boot and in which the shoe or boot includes a transverse axle affixed to the front thereof, the transverse axle being latched so as to permit the rotation of the shoe or boot around this transverse axle.

2. Description of Background and Relevant Information

A known binding of this type comprises a base in which a housing with a U-shaped section is provided, and is adapted to receive the axle of the shoe or boot (hereinafter referred to as the boot), which extends transversely to the longitudinal axis of the ski, and whose upper part is held by a longitudinally displaceable latch. The latch is biased by a spring in the latching position, and the positioning of the boot in the binding must be done from top to bottom by pushing the latch back into the open position. This positioning of the boot is thus carried out against the force of the spring which biases the latch in the latching position and consequently necessitates the exertion of significant force which is at least equal to that of the latching force of the system.

In this known binding, a latch is not horizontal, but is inclined from top to bottom so as to constitute a ramp which is adapted to permit the engagement of the axle of the boot in the housing and pushing back the axle in the open position of the latch.

As as result, in the latched position of the binding, the axle of the boot is only blocked by the lower free side of the latch, and the blocking obtained is thus not totally satisfactory.

Finally, the positioning of the boot in the binding, although facilitated by the engagement ramp of the latch, is difficult because it must be accompanied by a force, which must have a longitudinal component of sufficient intensity, to push the latch back into the open position.

SUMMARY OF THE INVENTION

The present invention relates to an automatic cross-country ski binding for a shoe or boot having a transverse journal axle which includes a housing adapted to receive the journal axle and a latch elastically biased in the longitudinal direction and adapted to latch the journal axle in the housing by longitudinal displacement of the latch. The latch is also biased for rotational displacement about an axis and includes means for upwardly pivoting it to a position of insertion so as to allow the passage of the axle towards the housing.

Movement of the latch from a latching position to the position of insertion is longitudinal movement followed by rotational movement and movement of the latch to a latching position from the position of insertion is rotational movement followed by longitudinal movement.

According to another aspect of the invention, means are provided for guidance of the latch in the longitudinal direction and for rotation. The means for guidance includes a slot or longitudinal opening cooperating with a projection on the latch.

According to another aspect of the invention, a force to be overcome for movement of the latch from the position of insertion to a latching position is that exerted by the biasing means in a substantially vertical direction and a force to be overcome for movement of the latch from a latching position to the position of insertion is that exerted by the biasing means in the longitudinal direction of the latch. The forces in the longitudinal and vertical direction of the latch may be exerted by a single biasing means which exerts on the latch a force whose direction of application is at a predetermined distance from the axis of rotation of the latch and the direction of force exerted by the biasing means extends obliquely with respect to the horizontal and at a predetermined distance from the rotation axis of the latch. The direction of force exerted by the biasing means may extend horizontally and at a predetermined distance from the rotation axis of the latch.

According to another aspect of the invention, the latch includes an activation element adapted to be pivoted downwardly directly by the journal axle of the boot for latching the journal axle. The latch includes a substantially C-shaped latching segment which is adapted to receive the journal axle. The activation element comprises a lower zone of the C-shaped segment. The latching segment cooperates with a vertical wall on the binding to close the C-shaped opening in a latching position of the latch.

The binding also includes an elastic bumper mounted on the latch which is adapted to elastically bias the boot during rotation. The bumper is adapted to be prestressed against the end of the boot during the closure of the binding.

A pivotally mounted unlatching lever includes a rotation axle for transverse movement, which is connected to the latch. The lever is adapted to move the latch to its position of insertion by rotation around the rotation axle. Guidance ramps are adapted to cooperate with the lever to cause displacement thereof towards the front of the latch during its rotation. The guidance ramps are inclined from top to bottom and from rear to front.

The unlatching lever is mounted for rotation about the rotation axle, and further includes a drive axis, which is displaceably mounted in guidance slots so that the latch is moved to its unlatched position during rotation of the unlatching lever and the latch is rotatably mounted for movement about the drive axis.

According to the invention, a cross-country ski binding for a shoe or boot having a transverse journal axle includes a base, and a latch having means to receive the journal axle. The latch has a latching position and an insertion position and is longitudinally movable and rotationally movable about an axis relative to the base between the latching position and the insertion position. Means are also included for biasing the latch in a longitudinal direction towards the latching position and for biasing the latch for rotation about the axis towards the insertion position. During movement of the latch from the latching position to the insertion position, the latch is mounted for movement in the longitudinal direction followed by rotational movement.

The means for biasing the latch in a longitudinal direction and the means for biasing the latch for rotation may comprise a single elastic element such as a spring. The spring is inclined with respect to the horizontal, whereby the force to overcome to move the latch from the insertion position to the latching position is exerted by the spring in the vertical direction and the force to overcome to move the latch from the latching position to the insertion position is exerted by the spring in the longitudinal direction. The angle of inclination of the spring is such that the force to overcome in the vertical direction is less than the force to overcome in the longitudinal direction.

According to another aspect of the invention, a substantially vertical wall extends from the base and includes an opening. The latch includes a segment adapted to be received by the opening when the latch is in the latching position. The segment is substantially S-shaped, the upper section of the segment being adapted to receive the journal axle, and the lower zone of the segment being received in the opening. An upper wall of the opening abuts the lower zone of the segment to prevent the latch from rotating to the insertion position when the lower zone is received in the opening.

An unlatching lever is pivotally mounted for movement about an axis relative to the base. The base includes a first loop and the latch includes a second loop adapted to longitudinally slide and rotate within the first loop. The unlatching lever is pivotally mounted for movement about an axle affixed to the second loop. Guidance ramps guide the lever for longitudinal movement.

According to another aspect of the invention, the latch includes a vertical arm and an elastic element exerts a biasing force against the arm. The biasing force is exerted at a predetermined distance about the axis of the latch, whereby the latch is biased to pivot to the insertion position.

According to the invention a cross country ski binding for a shoe or boot includes a base, a latch including means to hold the shoe or boot, which is movable relative to the base between a latching position and an insertion position, and means for biasing the latch, whereby the force to overcome to move the latch from the insertion position to the latching position is exerted by the means for biasing in the vertical direction and the force to overcome to move the latch from the latching position to the insertion position is exerted by the means for biasing in the longitudinal direction. The force to overcome in the vertical direction is less than the force to overcome in the horizontal direction. The means for biasing may be a spring that is inclined with respect to the horizontal.

In another embodiment, the latch includes a vertical arm and the means for biasing exerts a biasing force against the arm. The latch is rotatable about an axis relative to the base and the biasing force is exerted at a predetermined distance from the axis, whereby the latch is biased to pivot to the insertion position.

BRIEF DESCRIPTION OF THE DRAWINGS

The invention is further explained in the description which follows with reference to the drawings illustrating, by way of non-limiting examples, two preferred embodiments of the invention wherein.

DETAILED DESCRIPTION OF THE PREFERRED EMBODIMENTS

Figure 1:
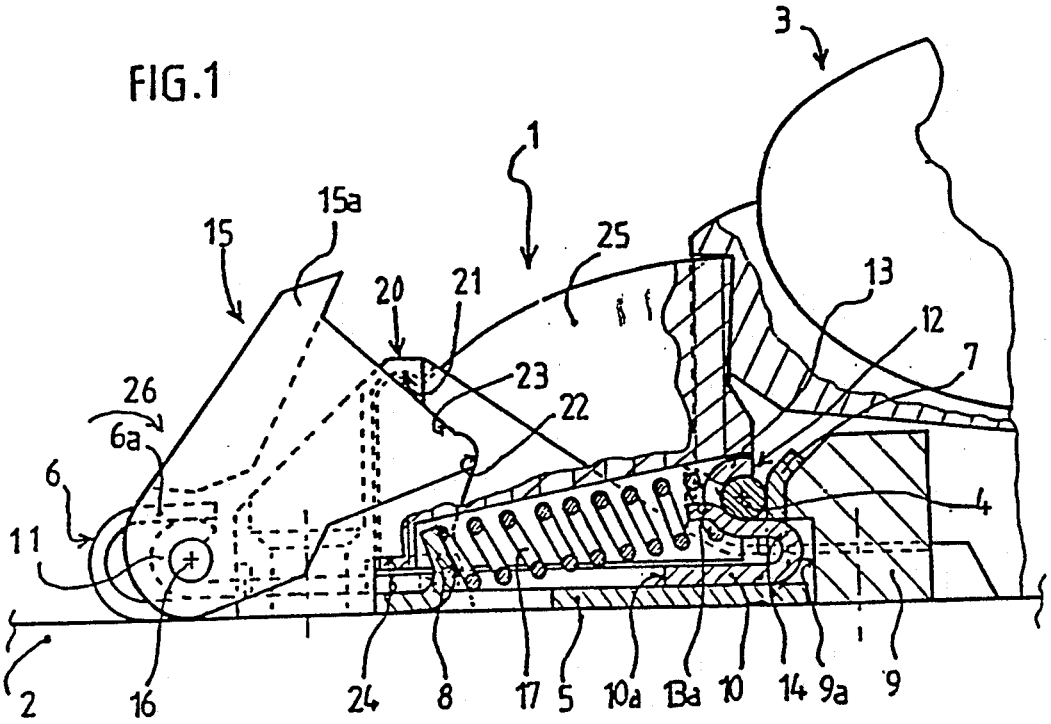
FIG. 1 is a partial longitudinal cross-sectional view of a binding in the latching position.

An object of the present invention is to overcome the above-described disadvantages with a cross-country ski binding in which the the boot is latched on a transverse axis by longitudinal displacement of a latch that is elastically biased towards a latching position, and in which the boot is easy to insert, and does not necessitate the exertion of significant force during the insertion, and which ensures good latching of the boot once the binding is closed, all while being of simple and inexpensive construction.

Another object of the present invention is to furnish a binding which is open in the insertion position, so as to facilitate the positioning of the boot.

These objects are attained, in the binding according to the present invention, by the fact that the latch is mounted for rotation so that it pivots upwardly in the insertion position of the binding so as to allow the passage of the axle of the boot. This facilitates the positioning of the boot in the binding.

According to a preferred embodiment, the latch is elastically biased upward and the force to be overcome to move the latch from the insertion position to the latching position is that exerted by the biasing means upwardly towards the top of the latch. The force to be overcome for the movement from the latching position to the insertion position is that exerted by the biasing means in the longitudinal direction of the latch (it is noted that these forces do not include frictional forces). Such a dissociation of forces to be overcome makes it possible to have a significant latching force on the latch by the associated elastic means while needing only small effort on the part of the user for the insertion and latching of the binding.

This embodiment is particularly advantageous in relation to known automatic bindings in which the insertion must be accompanied by the exertion of significant force by the user to overcome the latching force of the system.

According to another aspect of the invention, the latch is adapted to be pivoted downwardly for the latching of the binding directly by the journal axle of the boot. A latching element having a substantially C-shaped transverse section is adapted to receive the journal axle of the boot. The lower arm of this C-shaped element constitutes the activation element of the latch for the journal axle of the boot. Such an arrangement greatly facilitates insertion and latching and also simplifies the construction of the assembly.

Binding 1, according to the invention, is adapted to link boot 3 with cross-country ski 2, while allowing rotation of boot 3 around journal axle 4 which is perpendicular to its longitudinal axis. Journal axle 4 is located at the front of the boot.

Binding 1 includes base 5, which is adapted to be affixed on the upper surface of the ski by any appropriate means such as glue, screws, etc., and also includes latch 10 for automatic latching of journal axle 4 of the boot and lever 15 for unlatching.

Base 5, which is formed by an elongated plate, for example of sheet metal, comprises at its front end (i.e. its end situated at the left in the drawing), a C-shaped loop 6 which is oriented towards the rear.

Loop 6 is adapted to serve both as a front abutment for latch 10 and a rotational guidance bearing for unlatching lever 15, as will be described below.

Base 5 comprises, at its rear end (i.e. at the right in the drawing), vertical wall 7 which is adapted to form, with an associated part of latch 10, a housing for journal axle 4 of the boot.

Vertical wall 7 is substantially vertical and is perpendicular to the surface of base 5 and includes an opening 7a in its median portion. Opening 7a may have a substantially rectangular shape.

Opening 7a communicates with associated opening 9a provided in transverse bar 9 which is located behind vertical wall 7.

Transverse bar 9 guides the boot in a known manner, and is thus not described more in detail here. It also serves as support for vertical wall 7a.

As will be described below, opening 9a essentially serves as an abutment for latch 10, particularly when it tends to rotate towards the top in the counter-clockwise direction.

Base 5 includes substantially in a median portion, in the longitudinal direction, cut-out lug 8 which is slightly inclined towards the front, and adapted to guide and hold in place spring 17 which biases latch 10 towards the latching position.

Base 5 is covered by protective cuff 20 which is particularly adapted to cover screws which affix the base to the ski. Cuff 20 includes housing 21 for elastic bumper 25 which is adapted to exert a return force on the nose of boot 3 when it is lifted from the upper surface of the ski.

Cuff 20 includes a ramp 22 on each of its sides for guidance of unlatching lever 15 during its activation, and abutment surface 23 for when lever 15 is in the rest position. Cuff 20 also includes two lateral abutment surfaces 24 which are adapted to cooperate with latch 10 in its unlatched position. Abutment surfaces 24 can be clearly seen in FIG. 2.

Latch 10 is preferably formed from an elongated plate of sheet metal in the same manner as base 5. Latch 10 includes at its front end, (i.e. the end at the left in the drawing) a C-shaped loop 11 which is oriented towards the rear, and is adapted to slide within loop 6 of the base.

Loop 11 extends over approximately a half-arc of a circle, and has an exterior diameter less than the interior diameter of loop 6, so that it can both pivot and slide within loop 6, thus allowing both translation of the latch in the longitudinal direction, and rotation of the latch around its loop-shaped end 6.

It is noted that free arm 6a of loop 6 is longer than the corresponding arm of loop 11, which permits guidance in the longitudinal direction of the latch by loop 6.

Latch 10 includes at its rear end, curved section 12 in the form of a double loop which in transverse section forms the shape of an S. Curved section 12 includes C-shaped latching segment 13 having an interior diameter corresponding to the diameter of journal axle 4.

Latching segment 13 is adapted to serve both as a housing for axle 4 and to ensure the latching thereof by cooperation with vertical wall 7 of base 5. This construction makes it possible to reduce the number of elements.

Lower zone 14 of the S is adapted to permit the activation of the latch, i.e. the movement of the latch from the unlatched position to the latched position. Zone 14 is also adapted to cooperate with the upper wall of opening 9a to form an abutment for rotation of latch 10 in the counter-clockwise direction.

Latch 10 includes a maintenance lug 13a on latching segment 13, which is slightly inclined to be received by spring 17 and also includes longitudinal opening 10a for the passage of spring 17. As shown in the drawings, spring 17 is retained between maintenance lug 8 of base 5 and maintenance lug 13a of latch 10. Because of the inclination of the two lugs 8, 13a, spring 17 also has a slight inclination with respect to the horizontal. Thus it exerts on latch 10 a force F having both a vertical component F1 and a horizontal component F2 (see FIG. 2).

Thus, spring 17 biases the latch for upward rotation (i.e. in the counterclockwise direction) as well as for translation in the longitudinal direction towards the rear.

Of course, the inclination of the springs can be selected depending on the desired intensity of the vertical or horizontal components of the forces.

Figure 2:
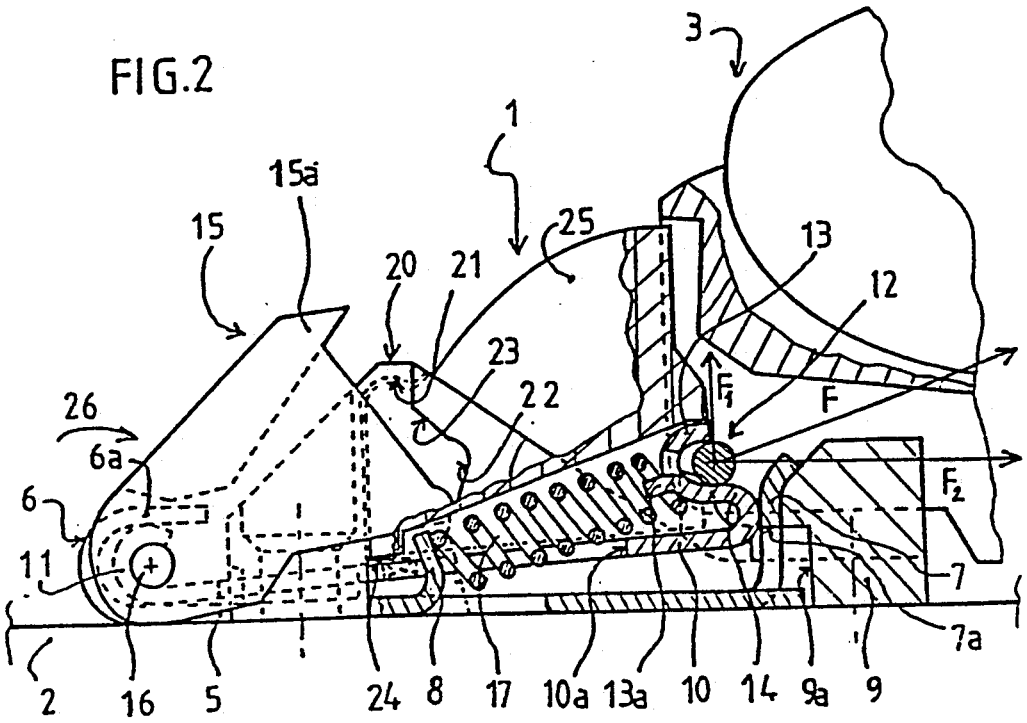
FIG. 2 is a view similar to FIG. 1 showing the insertion position of the binding.

As can be seen by the comparison of FIGS. 1 and 2, latch 10 can be displaced from a position of unlatching or insertion shown in FIG. 2, in which it is pivoted upwardly, to a latching position, shown in FIG. 1, in which it is pushed in the longitudinal direction towards the rear (i.e. towards the right in the drawing) by successive translation and rotation of the latch.

In the latching position shown in FIG. 1, latch 10 which is biased by spring 17 presses journal axle 4 against wall 7 and thus latches the axle. In the latching position, latch 10 abuts wall 7 in the longitudinal direction and abuts upper wall of opening 9a in rotation.

In the unlatching position shown in FIG. 2, latch 10 is biased upwardly by spring 17, and abuts wall 7 towards the rear by its lower zone 14. It also upwardly abuts abutment surfaces 24 of the cuff 20.

An elastic bumper 25 is solidly affixed to latch 10 for rotation and translation therewith. Bumper 25 is further retained in associated housing 21 of cuff 20, as previously indicated. Bumper 25 is thus displaced simultaneously with latch 10 to bias the nose of the boot in a known manner. It can be preferably arranged and designed so as to be prestressed against the nose of the boot during the latching of the binding.

Finally, unlatching lever 15 is constituted by an element in the shape of a stirrup whose two arms 15a are displaceable along guidance ramps 22 on the protective cuff. This lever 15 is pivotally mounted for movement around drive axle 16 which extends transversely to the binding. Axle 16 is embedded and solidly affixed to loop 11 of the latch. Each of the ends of axle 16 are secured to one of the arms 15a of the lever, so as to rotatably mount the lever.

As shown in FIGS. 1 and 2, guidance ramps 22 of lever 15 are inclined from top to bottom, and from the rear towards the front, so as to cause the displacement of lever 15 towards the front, (i.e. towards the left in the drawing) during the descent of arms 15a of lever 15 along ramps 22, during rotation of the lever.

As as result, the rotation of lever 15, in the clockwise direction indicated by arrow 26, causes the progressive motion of lever 15 and the moving of latch 10 towards the front, by means of axle 16 and consequently the unlatching of the binding.

Conversely, when the latch 10 is moved towards the rear under the effect of spring 17, it moves unlatching lever 15 which "rises" along guidance ramps 22 until it abuts against surfaces 23.

The operation of the binding according to the invention is as follows.

In the unlatching or insertion position, latch 10 is in the position shown in FIG. 2, i.e. pivoted upwardly and pushed back towards the front against spring 17. In this position, latch 10 exerts an additional force on spring 17. As previously indicated, in this position, latch 10 rearwardly abuts wall 7 and also upwardly abuts abutments 24 of cuff 20. It is also noted that in this position, latch 10 is biased for longitudinal movement towards the rear and in upward rotational movement by spring 17.

To move from the insertion position to the latching position, boot 3 is placed in the binding so that its journal axle 4 engages latching segment 13 of the latch, and a vertically oriented force is exerted on the axle to overcome force Fl, which is exerted by spring 17 in the vertical direction.

As can be seen, force Fl, which must be overcome to insert the boot in the binding, is greatly reduced with respect to the force F produced by the spring. In practice, force F1 will be weaker because the inclination of the spring with respect to the horizontal is slight, and the necessary force of insertion can be accomplished only by the weight of the user's foot.

Under the effect of this insertion effort, latch 10 pivots in the clockwise direction until it rests against base 5; at this moment, nothing opposes the longitudinal displacement of latch 10 towards the rear as it moves to its latching position, under the action of spring 17.

Thus latch 10 continues this translation movement until lower zone 14 of loop 12 is inserted in associated opening 9*a* of bar 9 (see FIG. 1). In this latching position, latch 10 presses journal axle 4 against wall 7 with the force exerted by spring 17 on the latch which constitutes the latching force.

Furthermore, in this latching position, latch 10 is blocked from translation by its contact with journal axle 4 which abuts against wall 7 and in rotation by the insertion of zone 14 of loop 12 in opening 9*a*. It is noted that in the latching position, journal axle 4 is blocked over its entire periphery by latch 10 and vertical wall 7. The latching obtained is thus very reliable and there is no possibility of inadvertent unlatching.

It is also noted that latch 10 serves both as a housing for journal axle 4 and as a latching system, which simplifies the construction by reduction of the number of necessary elements.

Finally, the biasing of the latch by spring 17 makes it possible to take up possible play, and thus guarantees perfect holding of journal axle 4.

The movement from the latching position to the unlatching position occurs quite simply by pivoting lever 15 in the direction of arrow 26. The pivoting of lever 15 in this direction causes longitudinal displacement thereof by gliding along ramps 22 and consequently movement of latch 10 towards the front. The activation of lever 15 can be very brief, since activation only has to be exerted until zone 14 of the latch moves out of opening 9*a*. At this time, latch 10 pivots upwardly in the counter-clockwise direction, under the effect of the vertical component F1 of the force exerted by spring 17, and takes the position for insertion shown in FIG. 2, thus freeing the journal axis 4 of the boot.

It is noted that, in the case of unlatching, the force which must be exerted on lever 15 should compensate for the horizontal component F2 of the force exerted by the spring on the latch. As for the insertion, the force which must be exerted by the user is less than horizontal component F2 produced by spring 17. This is particularly advantageous since it is relatively easy to insert the boot in the binding but the binding will not inadvertently unlatch.

The inclined position of spring 17 makes it possible to resolve the resistant forces opposing the insertion and removal of the binding, and thus makes it possible to reduce the force which must be exerted. Thus, in the case of insertion (latching) of the binding, the force which must be exerted by the user should compensate for the resistant force F1 exerted by spring 17 in the vertical direction, while in the case of removal (unlatching) of the binding, the force which must be exerted by the user should only compensate for the resistant force F2 exerted by spring 17 in the horizontal direction. Of course, in both cases, the user must also overcome the force of friction generated by the other component of force F, but such a friction force is negligible given the low coefficient of friction of the surfaces in contact, and consequently it is not taken into account in the present description.

The inclination of the spring makes it possible to selectively vary the value of forces F1 and F2. Such an arrangement is particularly advantageous with respect to the systems currently known, particularly for latching the binding, since the force which must be exerted by the user is tremendously reduced in the binding according to the present invention, while in known automatic bindings, the force exerted by the user must overcome the latching force.

It is noted that by an appropriate choice of spring 17 and its position, it is possible to obtain an insertion force which is very weak in relation to a significant latching force. This was not possible with known bindings.

Figure 3:
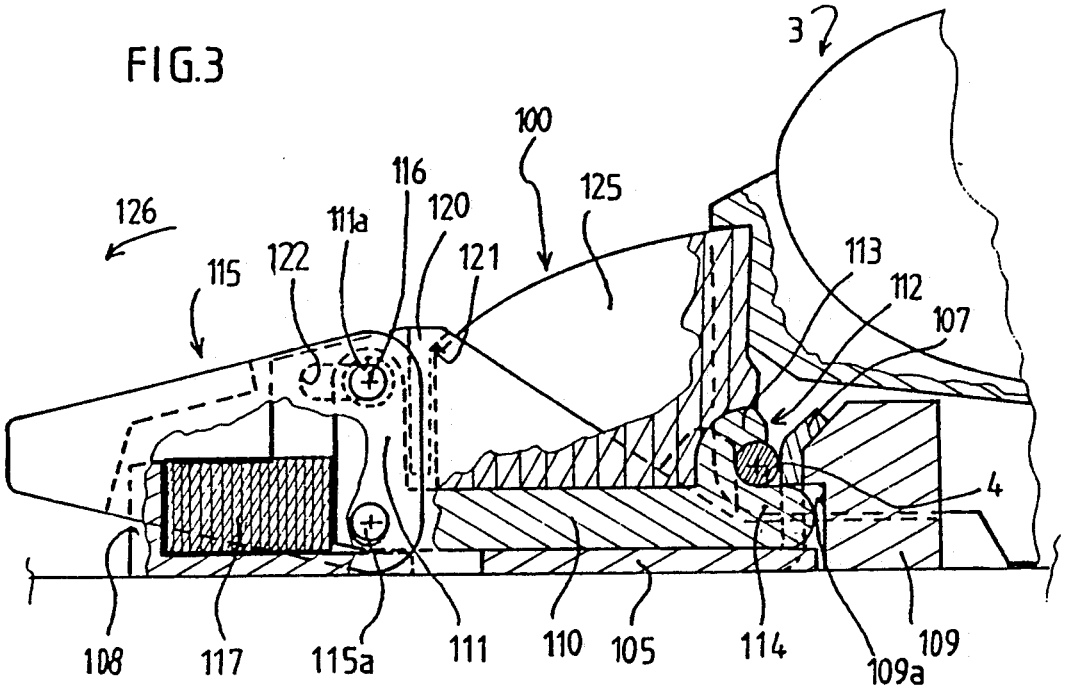
FIGS. 3 and 4 are views similar to FIGS. 1 and 2, respectively, according to another embodiment of the binding according to the invention.
Figure 4:
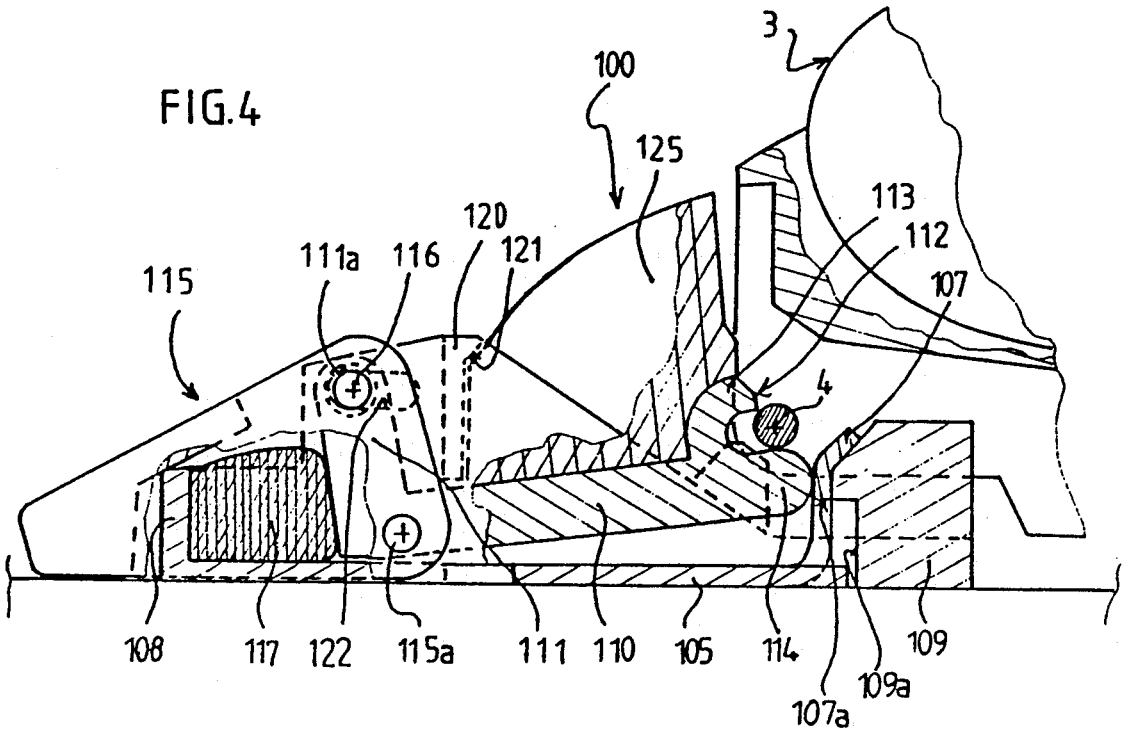

FIGS. 3 and 4 show a binding 100 according to another embodiment for which similar or identical elements will be designated by the same numerical references increased by 100.

Binding 100 comprises, as does binding 1 described above, base 105, latch 110 which is displaceable in the longitudinal direction and in rotation, unlatching lever 115, and protective cuff 120.

As in the embodiment of FIGS. 1 and 2, base 105 comprises vertical wall 107 having opening 107*a*, and transverse bar 109, which includes opening 109*a*.

Base 105 has at its front end a vertical element 108 adapted to hold an elastic bumper or other elastic means 117 for biasing the latch 110.

As in the preceding embodiment, protective cuff 120 defines a housing 121 for elastic bumper 125 which is adapted to exert a return force on the nose of the boot.

Unlatching lever 115 is mounted on cuff 120 for rotation about transverse axis 115*a*.

Cuff 120 includes two lateral horizontal slots 122 adapted to receive and guide transverse axle 116 which is affixed at the upper end of unlatching lever 115, and constitutes the axle for moving and rotating latch 110.

Latch 110, which has an essentially elongated shape, includes, at its front end, vertical arm 11 having a transverse housing 111*a* for axle 116 of unlatching lever 115, which is biased by elastic bumper 117.

Latch 110 also comprises at its rear end 112, unlatching element 113 having a C-shaped cross-section and adapted to cooperate with wall 117 for the latching of journal axle 4 of the boot. Lower zone 114 of element 113 is used, as in the preceding embodiment, for the activation of latch 110 for movement to the latched position.

The operation of binding 100 is similar to that previously described. The movement from the unlatched or insertion position, shown in FIG. 4, to the latched position, shown in FIG. 3, occurs by latch 110 pivoting downwardly about axle, 116 and then rearward translation for insertion in opening 109*a* under the biasing force of elastic means 117.

Conversely, the movement from the latched position to the unlatched position occurs by translation towards the front of latch 110 and then upward rotation thereof about axle 116 under the biasing force of elastic means 117.

The only difference between the two embodiments lies in the method for activation of unlatching lever 115 and in the method for biasing latch 110 by elastic means 117.

In the embodiment of FIGS. 3 and 4, the unlatching occurs by pressing lever 115 towards the bottom as indicated by arrow 126 in FIG. 3. By this pressure, lever 115 rotates downwardly about axis 115*a*, which causes movement of the lever towards the front of latch 110 by axle 116, which slides in slots 122 of protective cuff 120.

The method of biasing latch 110 is different from the first embodiment since elastic bumper 117 exerts a biasing force which is directed not obliquely but horizontally on latch 110.

However, since this biasing force is exerted on vertical arm 111 of latch 110, below and at a predetermined distance from rotation axle 116, it creates a rotation moment tending to make latch 110 pivot upwardly in the counter-clockwise direction. As a result, latch 110 is both subject to a force tending to displace it longitudinally and a force tending to make it pivot upwardly.

The offset position of elastic bumper 117 with respect to rotation axle 116 of the latch thus makes it possible to obtain the same effect as by inclined spring 17 in the embodiment of FIGS. 1 and 2, where the direction of application of force F is also offset with respect to the rotation axle 16 of latch 10.

It is noted that in either embodiment, the elastic means can be constituted by a spring, an elastic bumper or any other similar means or equivalent.

Obviously, the present invention is not limited only to the embodiments described above by way of non-limiting examples. For example, the guidance means of the latch could be replaced by a single slot substantially in the shape of an L, which provided in the base or the binding cuff, and receiving a projection or the like of the latch, i.e. by any guidance means successively ensuring a movement of translation and rotation.

In the same way, the latches and openings could have any other shape, and springs 17, 117 could be replaced by two or several springs each acting in one determined vertical or horizontal direction, without going beyond the scope of the present invention.

We claim:

1. An automatic cross-country ski binding for a shoe or a boot having a traverse journal axle, said binding comprising a housing adapted to receive said journal axle, a latch being movable between a latching position and a position of insertion for latching said journal axle in said housing, wherein said latch is rotationally mounted about a rotational axis, and wherein said rotational axis of said latch is mounted for longitudinal displacement in the binding, said latch being elastically biased in longitudinal and rotational displacement by biasing means towards the latching position of said journal axle of the boot in said housing.

2. The binding according to claim 1, wherein said biasing means elastically biases said latch for upward rotation.

3. The binding according to claim 1 wherein movement of said latch from a latching position to the position of insertion is longitudinal movement followed by rotational movement and movement of said latch to a latching position from the position of insertion is rotational movement followed by longitudinal movement.

4. The binding according to claim 3, and further comprising means for guiding said latch in the longitudinal direction.

5. The binding according to claim 3, and further comprising means for guiding said latch in rotation.

6. The binding according to claim 4 wherein said means for guiding includes a slot cooperating with a projection on said latch.

7. The binding according to claim 4, wherein said means for guiding includes a longitudinal opening cooperating with an associated projection on said latch.

8. The binding according to claim 2, wherein a force to be overcome for movement of said latch from the position of insertion to a latching position is that exerted by said biasing means in a substantially vertical component of direction of said latch.

9. The binding according to claim 2, wherein a force to overcome for movement of said latch from a latching position to the position of insertion is that exerted by said biasing means in a longitudinal component of the direction of said latch.

10. The binding according to claim 8, wherein a force to be overcome for movement of said latch from a latching position to the position of insertion is that exerted by said biasing means in a longitudinal component of the direction of said latch.

11. The binding according to claim 10, characterized in that the forces in the longitudinal and vertical components of the direction of the latch, are exerted by a single biasing means.

12. The binding according to claim 11, wherein said biasing means enters on said latch biasing force at a predetermined distance from the axis of rotation of said latch.

13. The binding according to claim 11, wherein the direction of force exerted by said biasing means extends obliquely with respect to the horizontal and at a predetermined distance from the rotation axis of said latch.

14. The binding according to claim 11, wherein the direction of force exerted by said biasing means extends horizontally, and at a predetermined distance from the rotation axis of said latch.

15. The binding according to claim 1, wherein said latch includes an activation element adapted to be pivoted downwardly directly by said journal axle of the boot for latching said journal axle.

16. The binding according to claim 15, wherein said latch includes a substantially C-shaped latching segment which is adapted to receive said journal axle.

17. The binding according to claim 16, wherein said activation element comprises a lower zone of said C-shaped segment.

18. The binding according to claim 16, wherein said latching segment cooperates with a vertical wall on the binding to close the C-shaped opening in a latching position of said latch.

19. The binding according to claim 1, further comprising an elastic bumper mounted on said latch which is adapted to elastically bias the boot during rotation, said bumper being adapted to be prestressed against the end of the boot during the closure of the binding.

20. The binding according to claim 1, further comprising a pivotally mounted unlatching lever which includes a rotation axle for transverse movement, said rotation axle being connected to said latch and said lever being adapted to move said latch to its position of insertion, by rotation around said rotation axle.

21. The binding according to claim 20, further comprising guidance ramps adapted to cooperate with said lever to cause displacement thereof towards the front of said latch during its rotation.

22. The binding according to claim 21, wherein said guidance ramps are inclined from top to bottom and from rear to front.

23. The binding according to claim 20, wherein said unlatching lever is mounted for rotation about said rotation axle, and further comprising a drive axis, said drive axis 116 being displaceably mounted in guidance slots so that said latch is moved to its unlatched position during rotation of said unlatching lever.

24. The binding according to claim 23, wherein said latch is rotatably mounted for movement about said drive axis.

25. A cross-country ski binding for a shoe or boot having a transverse journal axle, said binding comprising:

(a) a base;

(b) a latch including means to receive said journal axle, said latch having a latching position and an insertion position, said latch being rotationally movable about an axis relative to said base between said latching position and said insertion position, said axis being longitudinal movable relative to said base; and (c) means for biasing said latch in a longitudinal direction towards said latching position.

26. The binding according to claim 25, comprising means for biasing said latch for rotation about said axis towards said insertion position.

27. The binding according to claim 25, wherein during movement of said latch from said latching position to said insertion position, said latch is mounted for movement in the longitudinal direction followed by rotational movement.

28. The binding according to claim 26, wherein said means for biasing said latch in a longitudinal direction and said means for biasing said latch for rotation comprise a single elastic element.

29. The binding according to claim 28, wherein said elastic element is a spring.

30. The binding according to claim 29, wherein said spring is inclined with respect to the horizontal, whereby the force to overcome to move the latch from the insertion position to the latching position is exerted by said spring in the vertical direction and the force to overcome to move the latch from the latching position to the insertion position is exerted by said spring in the longitudinal direction.

31. The binding according to claim 30, wherein the angle of inclination of said spring is such that the force to overcome in the vertical direction is less than the force to overcome in the longitudinal direction.

32. The binding according to claim 25, further comprising a substantially vertical wall extending from said base, said wall including an opening, said latch including a segment adapted to be received by said opening when said latch is in the latching position.

33. The binding according to claim 32, wherein said segment is substantially S-shaped, the upper section of said segment being adapted to receive said journal axle, and the lower zone of said segment being received in said opening.

34. The binding according to claim 33, wherein an upper wall of said opening abuts said lower zone of said segment to prevent said latch from rotating to said insertion position when said lower zone is received in said opening.

35. The binding according to claim 25, further comprising an unlatching lever, said unlatching lever being pivotally mounted for movement about an axis relative to said base.

36. The binding according to claim 25, wherein said base includes a first loop having a portion opening towards said latch, and said latch includes a second loop having an opening and being adapted to longitudinally slide and rotate within said first loop.

37. The binding according to claim 36, further comprising an unlatching lever, said unlatching lever being pivotally mounted for movement about an axle affixed in the opening of said second loop.

38. The binding according to claim 37, further comprising means for guiding said lever for longitudinal movement.

39. The binding according to claim 38, wherein said means for guiding comprise ramps which are engageable by said lever.

40. The binding according to claim 28, wherein said latch includes a vertical arm, said elastic element exerting a biasing force against said arm.

41. The binding according to claim 40, wherein said biasing force is exerted at a predetermined distance about said axis of said latch, whereby said latch is biased to pivot to said insertion position.

42. A cross country ski binding for a shoe or boot, said binding comprising:

(a) a base;

(b)a latch including means to hold said shoe or boot, said latch being rotationally movable about an axis against a biasing force relative to said base between a latching position and a insertion position, said axis being longitudinally movable relative to said base; and (c) means for biasing said latch comprising:

(i) means for biasing said latch during movement from said insertion position to said latching position which exerts a component of a vertically directed force; and (ii) means for biasing said latch during movement from said latching position to said insertion position which exerts a component of a longitudinally directed force.

43. The binding according to claim 42, wherein the force in the vertical direction is less than the force in the longitudinal direction.

44. The binding according to claim 43, wherein said means for biasing is a spring.

45. The binding according to claim 44, wherein said spring is inclined with respect to the horizontal.

46. The binding according to claim 43, wherein said latch includes a vertical arm, said means for biasing exerting a biasing force against said arm.

47. The binding according to claim 46, wherein said biasing force is exerted at a predetermined distance from said axis, whereby said latch is biased to pivot to said insertion position.

* * * * *